US006921261B2

(12) United States Patent
Perry

(10) Patent No.: US 6,921,261 B2
(45) Date of Patent: Jul. 26, 2005

(54) AIR-HEATING GAS BURNER

(75) Inventor: Douglas M. Perry, Muncie, IN (US)

(73) Assignee: Maxon Corporation, Muncie, IN (US)

( * ) Notice: Subject to any disclaimer, the term of this patent is extended or adjusted under 35 U.S.C. 154(b) by 0 days.

(21) Appl. No.: 10/343,130

(22) PCT Filed: Sep. 28, 2001

(86) PCT No.: PCT/US01/42393

§ 371 (c)(1),
(2), (4) Date: Jan. 28, 2003

(87) PCT Pub. No.: WO02/27238

PCT Pub. Date: Apr. 4, 2002

(65) Prior Publication Data

US 2005/0014103 A1 Jan. 20, 2005

Related U.S. Application Data

(60) Provisional application No. 60/236,295, filed on Sep. 28, 2000.

(51) Int. Cl.[7] ..... F23D 14/70

(52) U.S. Cl. ..... 431/351; 431/354; 432/222; 126/110 C

(58) Field of Search ..... 431/351, 354, 431/350, 8, 9, 10, 12, 115, 116; 432/187, 194, 196, 145, 222; 126/110 C, 110 R, 99 R, 116 R

(56) References Cited

U.S. PATENT DOCUMENTS

| | | | | |
|---|---|---|---|---|
| 3,051,464 A | | 8/1962 | Yeo et al. | 432/222 |
| 3,178,161 A | | 4/1965 | Yeo et al. | 431/351 |
| 3,186,697 A | | 6/1965 | Haedike et al. | 432/47 |
| 3,297,259 A | | 1/1967 | Maxon, Jr. et al. | 239/397.5 |
| 3,494,711 A | * | 2/1970 | Spielman | 431/165 |
| 3,649,211 A | | 3/1972 | Vosper | 431/350 |
| 4,573,907 A | | 3/1986 | Coppin, et al. | 431/351 |
| 4,869,665 A | | 9/1989 | Coppin | 431/351 |
| 4,929,541 A | | 5/1990 | Potter, et al. | 431/351 |
| 5,131,836 A | | 7/1992 | Coppin | 432/187 |

FOREIGN PATENT DOCUMENTS

GB 2 117 506 3/1982

OTHER PUBLICATIONS

Print out of http://www.midco–intl.com/makeup.htm, p.1 of 2, regarding Make–Up Air Burners, Printed Jul. 6, 2000.

Copy of the Eclipse AH–MA Air Heat Burner v2.10, Design Guide 160, Printed Apr. 2000, pp. 1–25.

* cited by examiner

*Primary Examiner*—Josiah C. Cocks
(74) *Attorney, Agent, or Firm*—Barnes & Thornburg LLP

(57) ABSTRACT

A burner (10, 210, 310, 410) including a fuel manifold (12, 212, 312, 412), perforated air-mixing plates (14, 16, 214, 218, 414) coupled to the fuel manifold to define a fuel-air mixing region (22, 473) therebetween above the fuel manifold, and unperforated air-deflector wings (24, 26, 216, 236, 428). Each unperforated air-deflector wing is coupled to one of the perforated air-mixing plates such that each unperforated air-deflector wing extends upwardly from and at an angle to the perforated air-mixing plate to which it is coupled.

27 Claims, 11 Drawing Sheets

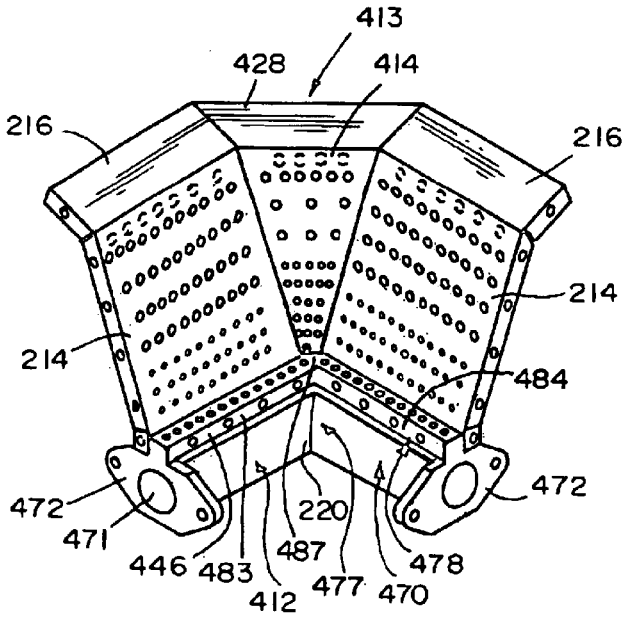
FIG. 27
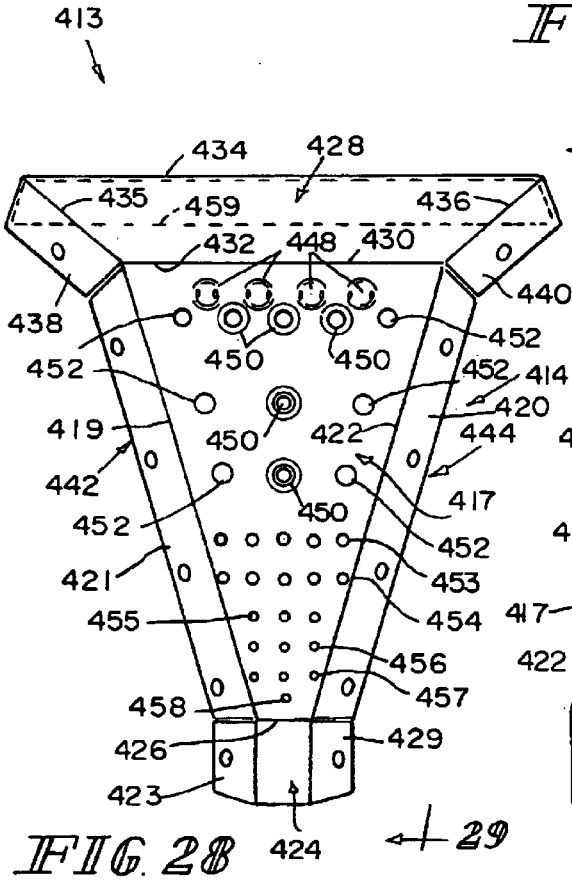
FIG. 28
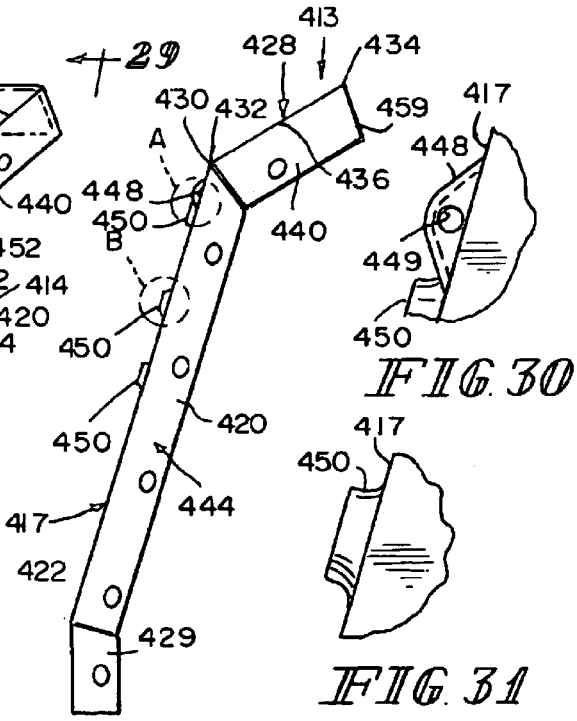
FIG. 29
FIG. 30
FIG. 31

AIR-HEATING GAS BURNER

CROSS-REFERENCE TO RELATED APPLICATION

This application claims priority under 35 U.S.C. § 119(e) to U.S. Provisional Application Ser. No. 60/236,295, filed Sep. 28, 2000, which is expressly incorporated by reference herein.

BACKGROUND AND SUMMARY OF THE INVENTION

The present invention relates to air-heating gas burners, and particularly to a burner for burning a mixture of gaseous fuel and process air to heat the air for use in industrial applications. More particularly, the present invention relates to a line burner assembly including a fuel manifold and mixing plates mounted on the fuel manifold and formed to include apertures through which process air passes to mix with fuel discharged from the fuel manifold to produce a flame between the mixing plates.

Line burner assemblies are able to burn a mixture including a gaseous fuel and air to produce a flame. Line burners are disclosed in U.S. Pat. Nos. 3,297,259; 4,869,665; and 5,131,836, which patents are hereby incorporated by reference herein. The disclosures in U.S. Pat. Nos. 3,051,464; 3,178,161; and 4,573,907 are also hereby incorporated by reference herein.

It is known to provide elongated line burners which are formed to include a plurality of gaseous fuel openings and a plurality of air openings along the length of the burner. Such line burners are known as "nozzle mix" line burners. Examples of nozzle mix line burners are shown in U.S. Pat. Nos. 4,340,180 and 4,403,947, which patents are hereby incorporated by reference herein.

It is also known to supply a premixed gaseous fuel and combustion air mixture to a manifold of a line burner and ignite the mixture to produce a flame. Examples of "premix" line burners are shown in U.S. Pat. Nos. Re. 25,626; 3,178,161; 3,297,259; 4,573,907; and 4,869,665, which patents are hereby incorporated by reference herein.

Air-heating gas burners are well-suited to warm or temper incoming air into buildings to relieve the building heating plant of peak or extra loads. They can be used to create a warm air curtain on open docks and for process drying in industrial or agricultural applications.

Line burners are useful in various industrial applications where it is required to have a specific temperature distribution over a predetermined space or area. Examples of applications where line burners are used include graphics applications, incinerators, turbine boosters, and board dryers. In a graphics application, for example, premix line burners are used to generate hot air to dry ink or solvents from printing presses.

Process air is that air that is produced in a factory or industrial process and found to contain various inert matter entrained therein. It is desirable to dispose of this process air in an environmentally sound way to minimize unwanted discharge of inert matter into the environment. One way to dispose of many of the contaminants entrained in process air is to incinerate it by burning a mixture of gaseous fuel and process air in a line burner. For example, process air containing solvents emitted from a printing press can be introduced into a line burner and mixed with gaseous fuel to produce a flammable mixture. These entrained solvents are incinerated by the flame of the line burner as the process air passes through the mixing region of the line burner and the mixture of gaseous fuel and process air is ignited. It is important that this mixture contain enough oxygen to kindle or sustain a flame.

According to the present invention, a line burner includes a fuel manifold, a pair of perforated air-mixing plates coupled to the fuel manifold to define a fuel-air mixing region therebetween above the fuel manifold, and an unperforated air-deflector wing coupled to the top end of each air-mixing plate. The air-deflector wings are sized and arranged to stimulate recirculation of combustion products back into the primary reaction zone in the fuel-air mixing region to increase residence time of combustion products in a high-temperature region of the flame produced in the fuel-air mixing region.

In illustrative embodiments, the air-flow apertures formed in at least some of the air-mixing plates are sized, shaped, and spaced in a pattern selected to improve aeration in the fuel-air mixing region. In a section of the aeration pattern, the apertures are arranged in rows and columns. With respect to the rows, the apertures nearer the side edges of the air-mixing plates are larger than the apertures nearer the middle of the air-mixing plates. With respect to the columns, the apertures become smaller going down each column.

In other illustrative embodiments, a burner includes an elbow-shaped manifold and a wedge-shaped air-mixing plate mounted to the fuel manifold to accommodate a turn of the fuel manifold. The wedge-shaped air-mixing plate includes first and second side edges that diverge away from one another as they extend away from the fuel manifold.

Additional features of the invention will become apparent to those skilled in the art upon consideration of the following detailed description of illustrative embodiments of the invention exemplifying the best mode of carrying out the invention as presently perceived.

BRIEF DESCRIPTION OF THE DRAWINGS

The detailed description particularly refers to the accompanying figures in which:

FIG. 27 is a perspective view of the burner of FIG. 16, with the corner air-mixing plate removed, showing a wedge-shaped air-mixing plate positioned at a turn of the elbow-shaped fuel manifold;

FIG. 28 is a side elevation view of the wedge-shaped air-mixing plate of FIG. 27;

FIG. 29 is an end elevation view as viewed in a direction suggested by line 29—29 of FIG. 28;

FIG. 30 is an enlarged view of a region A of the wedge-shaped air-mixing plate shown in FIG. 29;

FIG. 31 is an enlarged view of a region B of the wedge-shaped air-mixing plate shown in FIG. 29.

DETAILED DESCRIPTION OF THE DRAWINGS

Figure 1:
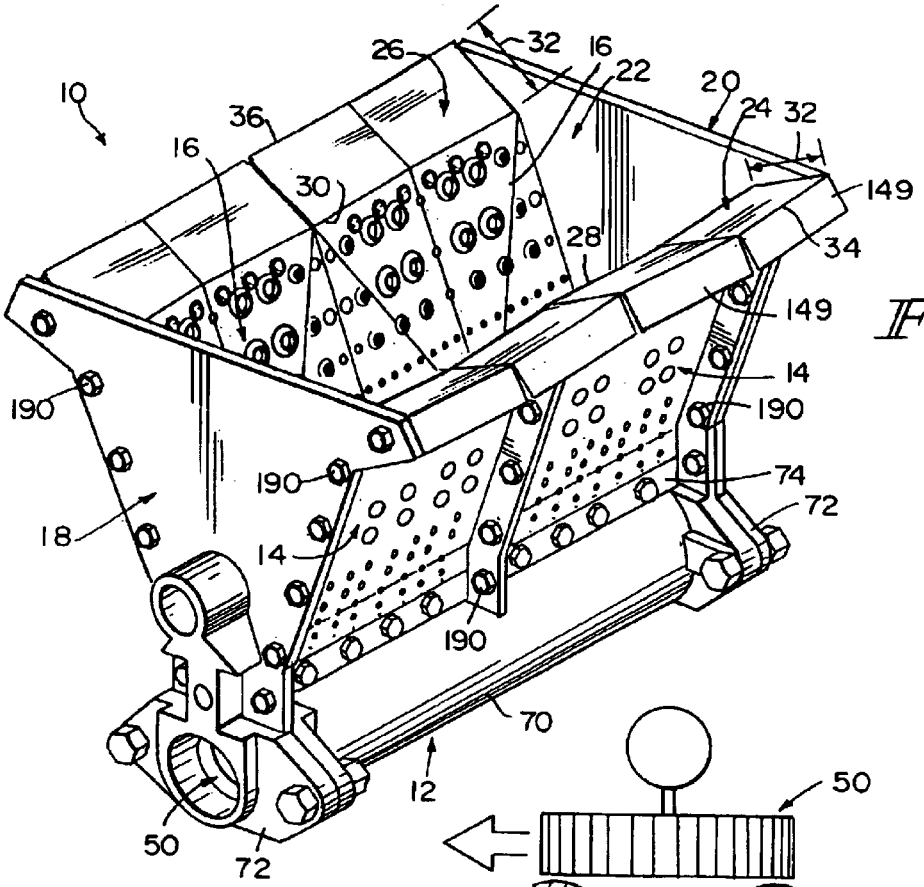
FIG. 1 is a perspective view of a line burner assembly in accordance with the present disclosure showing a fuel manifold extending along the length of the burner assembly between a pair of vertical end plates, four diverging perforated air-mixing plates anchored to the underlying fuel manifold, and an angled air-deflector wing coupled to a top edge of each of the air-mixing plates.
Figure 2:
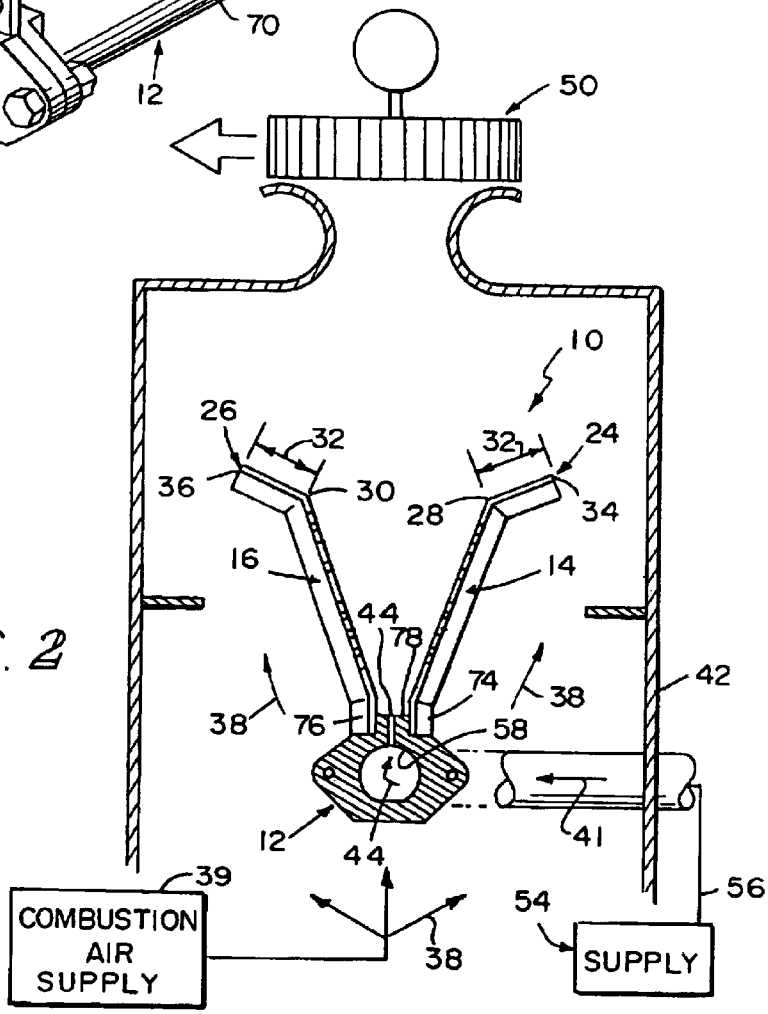
FIG. 2 is a sectional view taken through the line burner assembly of FIG. 1 showing the line burner assembly situated in a process air duct and various air and fuel supply and other apparatus associated with the line burner assembly.

A line burner 10 is illustrated in FIGS. 1 and 2. Line burner 10 includes a fuel manifold 12 and first and second air-mixing plates 14, 16. End plates 18, 20 are positioned to lie at opposite ends of line burner 10.

A mixing region 22 is provided above fuel manifold 12 to contain a fuel-air mixture therein and support a flame upon combustion of the fuel-air mixture admitted into mixing region 22. Mixing region 22 is bounded in part by fuel manifold 12, air-mixing plates 14, 16, and end plates 18, 20.

Figure 3:
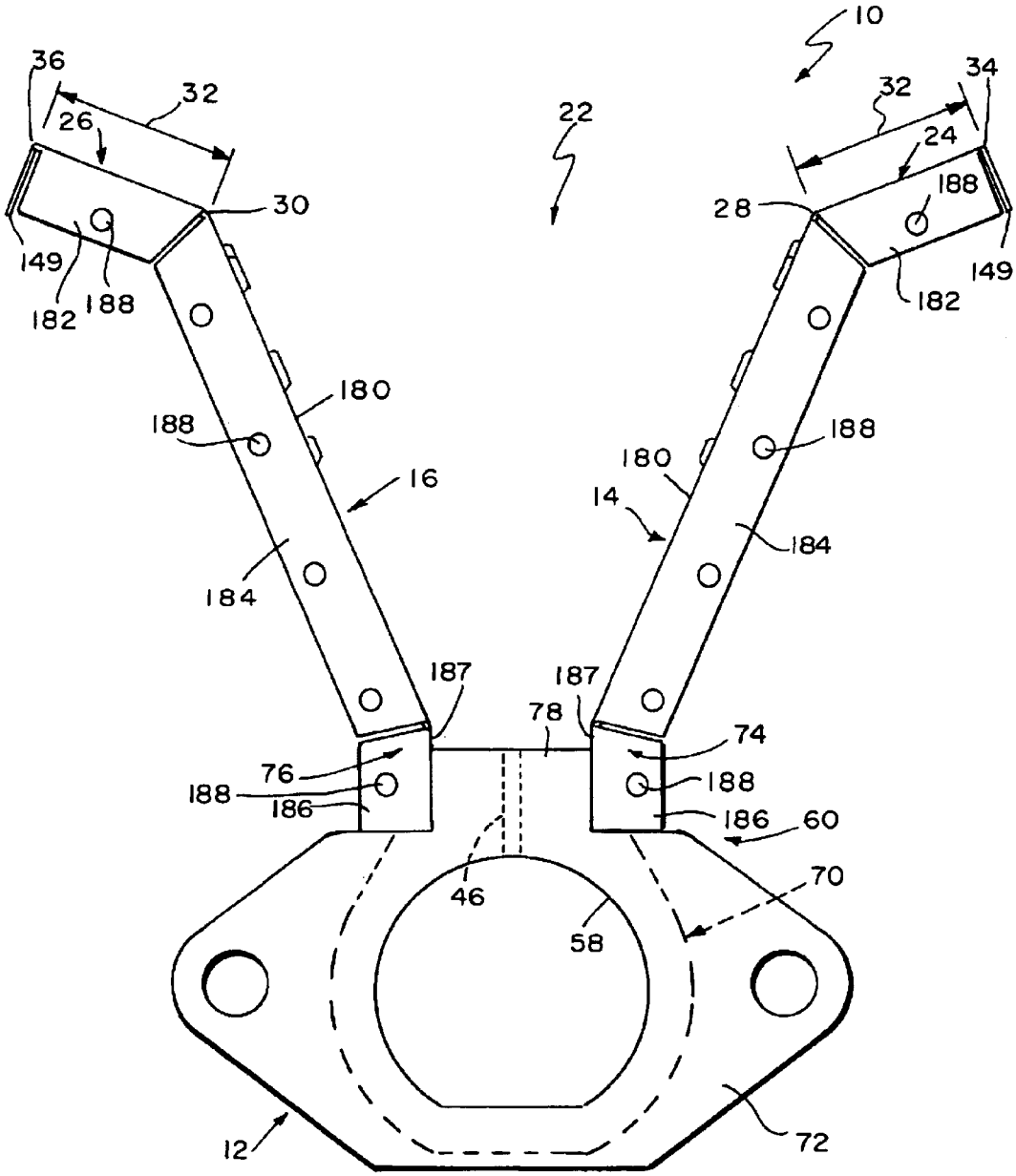
FIG. 3 is an enlarged end elevation view of the line burner section of FIG. 1 with the end plates removed showing the width and orientation of the unperforated air-deflector wings coupled to the top ends of the diverging air-mixing plates.
Figure 8:
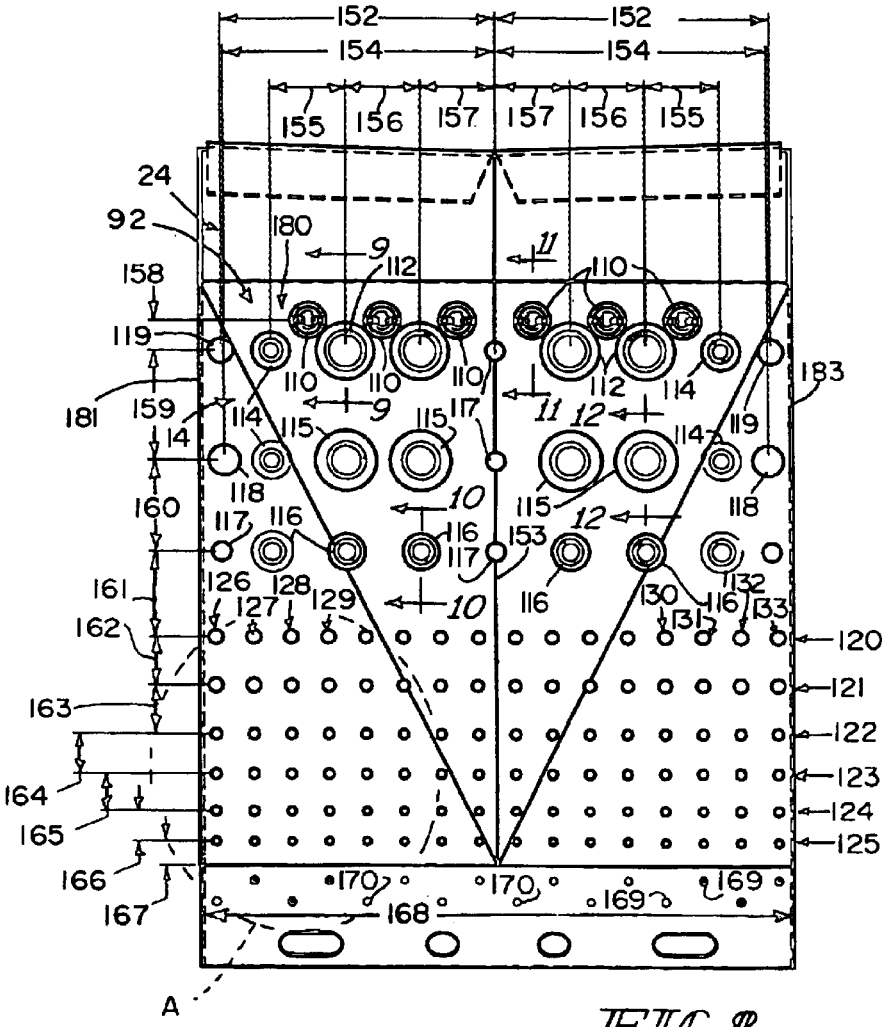
FIG. 8 is a side elevation view of an inner surface of the air-mixing plate shown in FIG. 5 as viewed in a direction suggested by line 8—8 of FIG. 5 and showing a presently preferred pattern of air flow apertures formed in the air-mixing plate.
Figure 13:
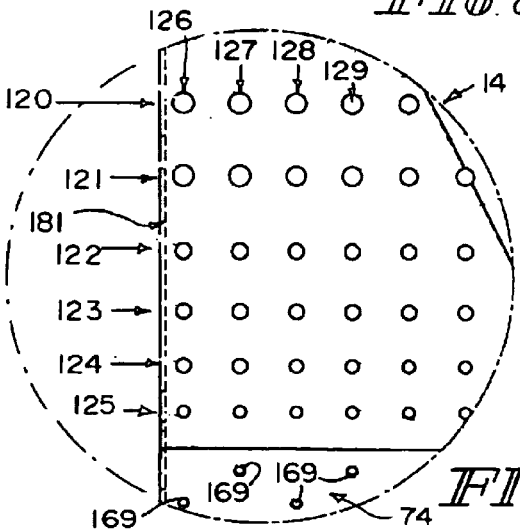
FIG. 13 is an enlarged view of a region A of the air-mixing plate of FIG. 8 showing the size and arrangement of some of the apertures in the air-mixing plate.

Air-mixing plates 14, 16 are located on opposite sides of fuel manifold 12 as shown, for example, in FIGS. 1–3. Each air-mixing plate 14, 16 is formed to include an array of air-flow apertures. In a preferred embodiment, the array of air-flow apertures is configured as shown in FIGS. 8 and 13 to create a more uniform flame and minimize "sooting" potential. Sooting means the formation of a black substance consisting of very small particles of carbon or heavy hydrocarbons resulting from incomplete combustion.

Air-deflector wings 24, 26 are coupled to top edges 28, 30 of air-mixing plates 14, 16 as shown, for example, in FIGS. 1–5, and 8 and arranged in splayed relation to one another. Air-deflector wings 24, 26 are positioned to lie between end plates 18, 20. Air-deflector wings 24, 26 reshape a burner flame pattern to create a re-circulation of combustion products into the flame to increase fuel-air mixing effectiveness and combustion intensity resulting in lower emissions and shorter flame length.

Wings 24, 26 extend upwardly and away from mixing plates 14, 16. Each air-deflector wing 24, 26 is unperforated and characterized by a width 32 that extends from top edge 28 to outer wing edge 34 for air-deflector wing 24 and that extends from top edge 30 to outer wing edge 36 for air-deflector wing 26. In a presently preferred embodiment, the width 32 of each of air-deflector wings 14, 16 is about two inches as shown, for example, in FIGS. 1, 2, and 5. Process air is manipulated and channeled by the unperforated air-deflector wings 24, 26 so that the air does not quench a flame produced in fuel-air mixing region 22 so as to minimize the formation of nitrogen dioxide and carbon monoxide. This yields a more intense and compact flame.

Figure 4:
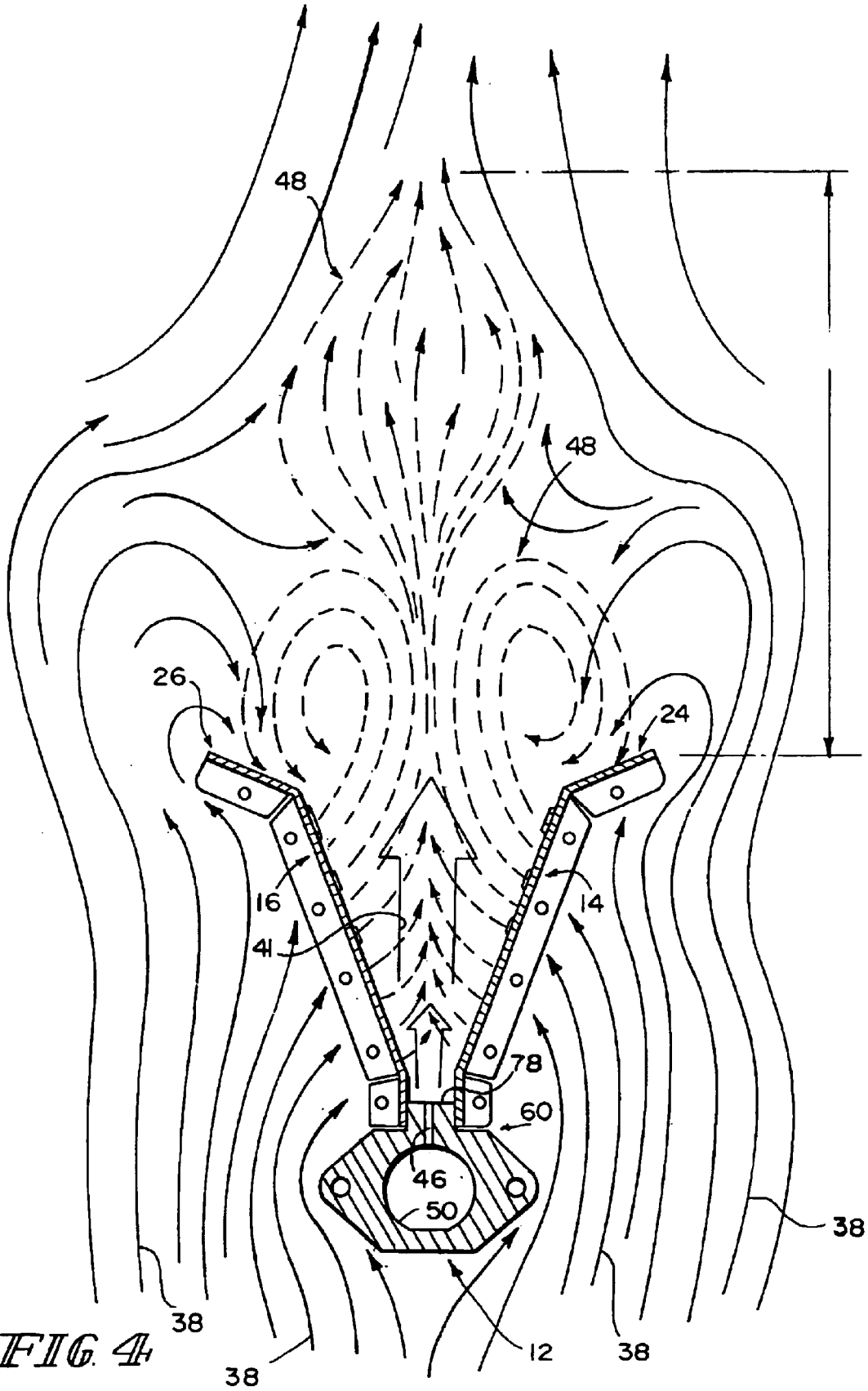
FIG. 4 is a diagrammatic view similar to FIG. 3 showing the pattern of flow of fuel and air around the line burner and showing how the unperforated air-deflector wings influence flow of combustion air and products of combustion to facilitate recirculation of combustion products back into the primary reaction zone to increase residence time of combustion products in a high-temperature region of the flame.

Process (or other combustion) air 38 provided by combustion air supply 39 is circulated through a duct 42 surrounding line burner 10 as shown diagrammatically in FIG. 2. Process air 38 moves around line burner 10 as shown in FIGS. 2 and 4. A certain amount of process air 38 passes into mixing region 22 formed in line burner 10 through the air-flow apertures formed in air-mixing plates 14, 16 as shown diagrammatically in FIG. 4.

Process air 38 typically contains a mixture of oxygen and inert gases. The process air passing into mixing region 22 mixes with gaseous fuel 41 supplied to the mixing region through fuel-flow apertures 46 formed in fuel manifold 12 to provide a combustible process air-and-fuel mixture in mixing region 22 of line burner 10. This combustible process air-and-fuel mixture is ignited to produce a flame 48 having roots in mixing region 22 as shown, for example, in FIG. 4.

A fan 50 is coupled to an outlet 52 formed in duct 42 to draw process air 38 to burner 10 and to discharge air heated in duct 42 to a destination away from duct 42 as shown in FIG. 2. It is within the scope of this disclosure to place line burner 10 in any suitable environment.

Figure 6:
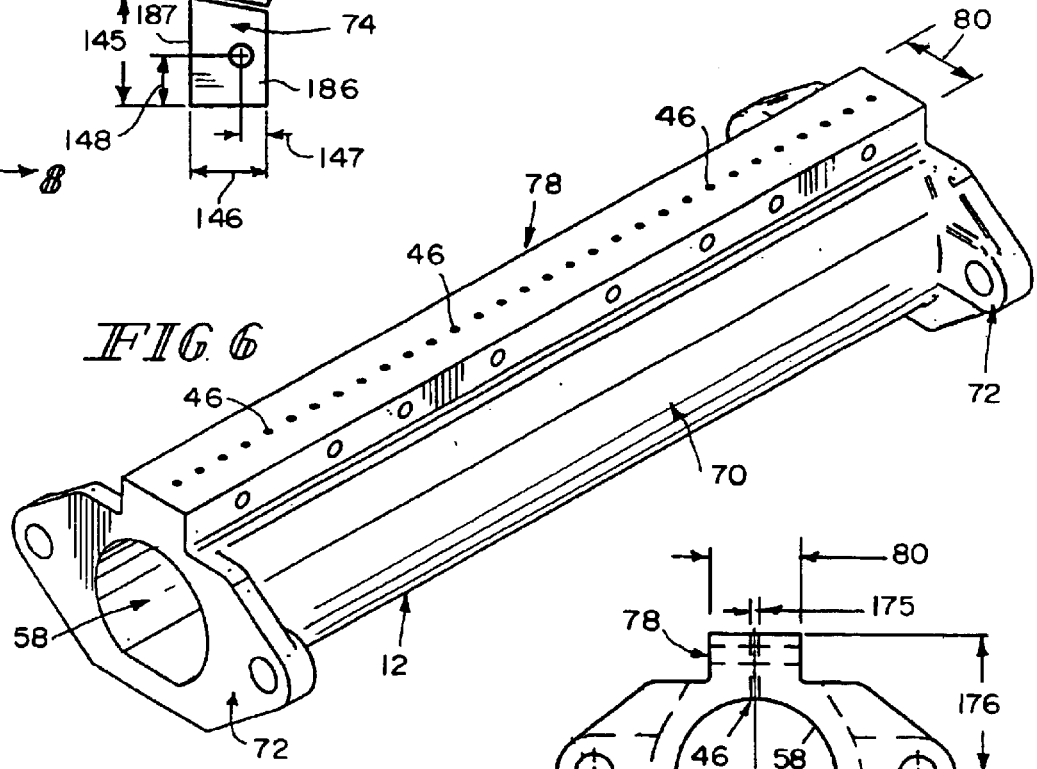
FIG. 6 is a perspective view of a fuel discharge unit or manifold included in the line burner of FIG. 1.
Figure 7:
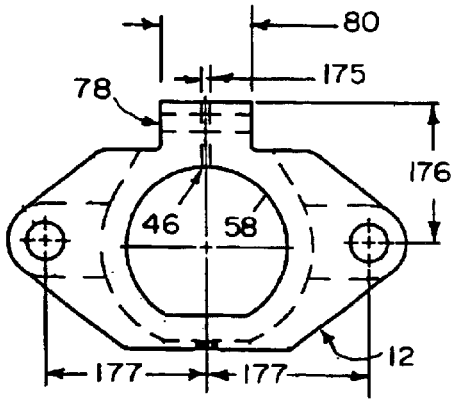
FIG. 7 is an end view of the fuel manifold shown in FIG. 6.

Fuel manifold 12 includes a base 70, mounting flanges 72 at opposite ends of base 70, and a plate spacer 78 that is coupled to a top portion of base 70 as shown in FIGS. 6 and 7. Plate spacer 78 is positioned to lie between base portions 74, 76 of air-mixing plates 14, 16 as shown, for example, in FIGS. 2–4. Plate spacer 78 is characterized by a width 80 extending laterally from one base portion 74 to another base portion 76 as shown best in FIG. 3. In a presently preferred embodiment, plate spacer width 80 is 1.062 inches as shown, for example, in FIGS. 6 and 7. Width 80 is wider in manifold 12 than in prior art manifolds. The wider width 80 associated with plate spacer 78 maximizes burner turndown and flame stability and attachment. Turndown is the ratio of the maximum and minimum firing rate for a particular burner where firing rate is the measure of how much gaseous fuel is consumed per hour by a burner.

A fuel supply 54 is provided to supply gaseous fuel 41 to fuel manifold 12 through fuel supply line 56 as shown diagrammatically in FIG. 2. A fuel transfer conduit 58 is formed in base 70 of fuel manifold 12 to receive fuel 41 discharged from fuel supply line 56. Fuel transfer conduit 58 is arranged to extend along the length of fuel manifold 12 to communicate with each of the fuel-flow apertures 46 formed in plate spacer 78. As shown in FIG. 6, a series of fuel-flow apertures 46 is formed in plate spacer 78 to provide a fuel flow path to allow fuel to pass from fuel transfer conduit 58 into the mixing region 22 located above fuel manifold 12 and between air-mixing plates 14, 16.

Fuel transfer conduit 58 has an inner diameter of 1.88 inches and larger volume than prior art manifolds. This permits higher burner firing rates without increasing pressure drop or inlet pressure requirements.

Line burner 10 operates to minimize emission of carbon monoxide and nitrogen dioxide in the products of combustion by minimizing flame quenching through enhanced aerodynamic design resulting in improved mixing of fuel and air. In direct-fired make-up-air heating applications, a large amount of air is heated to a relatively low temperature (e.g., less than 160° F.). The volume of air which flows across the burner is 3,000 to 4,000 times the amount of air required to burn the fuel completely. When an excessive amount of air is introduced into the combustion zone, flame quenching occurs, causing flame temperatures to drop below the level necessary to completely oxidize the fuel molecules.

To prevent the products of combustion from being quenched or swept away by the process air, line burner 10 includes unperforated air-deflector wings 24, 26 at the outer ends of air-mixing plates 14, 16 to facilitate re-circulation of combustion products back into the primary reaction zone (as shown diagrammatically in FIG. 4), increasing residence time of combustion products in the high-temperature region of the flame.

Fuel manifold 12 includes a wide plate spacer 78 that is sized to maximize the protected volume of the reaction zone and improve flame stability and flame attachment at the fuel discharge nozzles over a wide operating range. The improved aerodynamics and flame attachment creates a more compact and intense reaction zone that minimizes flame quenching. Increased residence time at high temperatures and increased combustion intensity promotes the oxidation of carbon monoxide to carbon dioxide and minimizes formation of nitrogen dioxide.

Each of air-mixing plates 14, 16 includes a panel 180, as illustrated, for example, in FIG. 8. Each panel 180 is coupled to respective air-deflector wing 24, 26 and base portion 74, 76 and includes respective top edge 28, 30, a first side edge 181, and a second side edge 183.

Figure 5:
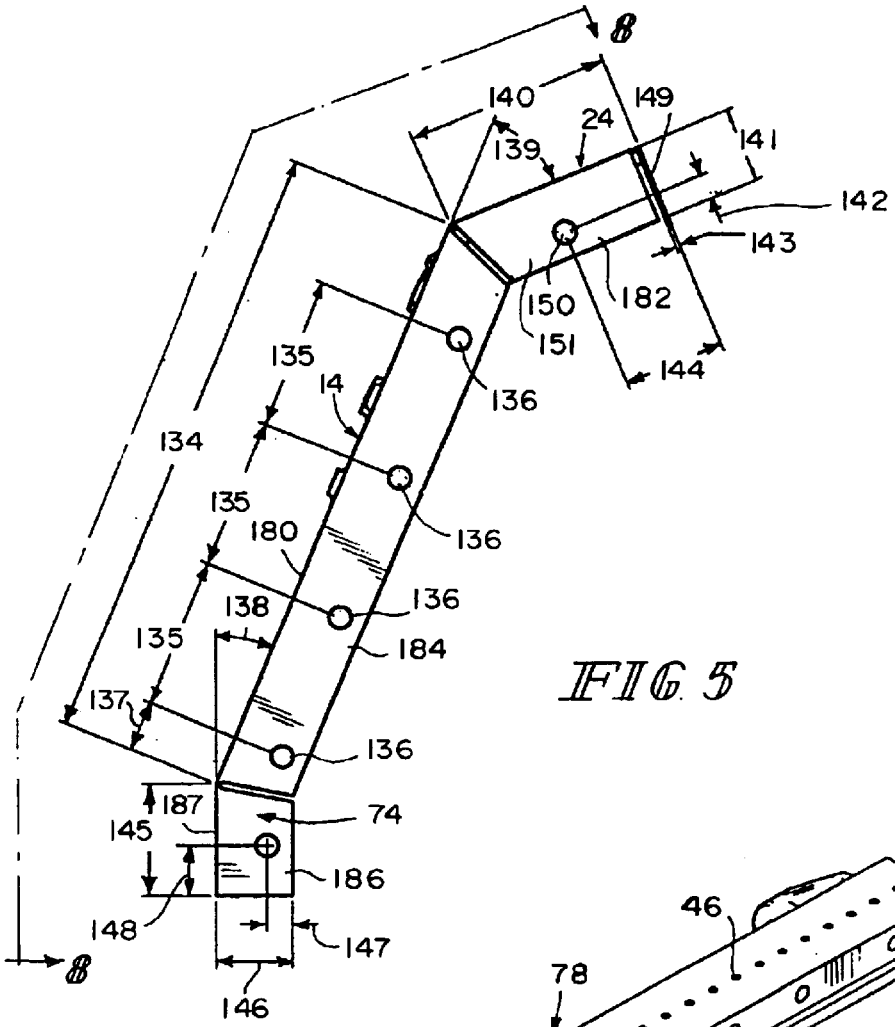
FIG. 5 is an end elevation view of one of the air-mixing plates showing dimensions associated with the air-mixing plate along one side of the line burner assembly and a solid air-deflector wing coupled to the top end of that air-mixing plate.

A pair of upper side flanges 182 are coupled to either side of each air-deflector wing 24, 26, as illustrated, for example, in FIGS. 3 and 5. A pair of intermediate side flanges 184 are coupled to respective side edge 181, 183 of each panel 180. A pair of lower side flanges 186 are coupled to either side of a panel 187 of respective base portions 74, 76. Flanges 182, 184, 186 are formed to include apertures 188 sized to received fasteners 190 to couple adjacent air-mixing plates 14, 16 together or to couple an air-mixing plate 14, 16 to an end plate 18, 20.

Figure 10:
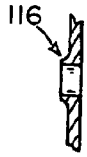
FIG. 10 is a sectional view of another air-mixing plate aperture taken along line 10—10 of FIG. 8.
Figure 11:
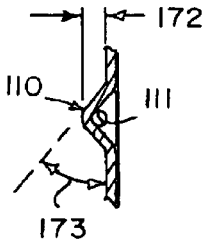
FIG. 11 is a sectional view of yet another air-mixing plate aperture taken along line 11—11 of FIG. 8.
Figure 12:
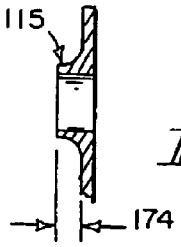
FIG. 12 is a sectional view of still another air-mixing plate aperture taken along line 12—12 of FIG. 8.

Panel 180 of each air-mixing plates 14, 16 includes an array 92 of apertures and an illustrative array is shown in FIG. 8. Array 92 includes an upper section and a lower section, a portion of which is shown in FIG. 13. The upper section includes six domes 110 each formed to include a pair of apertures 111 (FIG. 11); a first set 112 of protrusion apertures (FIG. 9); a second set 113 of protrusion apertures (FIG. 8); a third set 114 of protrusion apertures (FIG. 12); a fourth set 115 of protrusion apertures (FIG. 12); a fifth set 116 of protrusion apertures (FIG. 10); apertures 117 (FIG. 8); apertures 118 (FIG. 8); and apertures 119 (FIG. 8).

Figure 9:
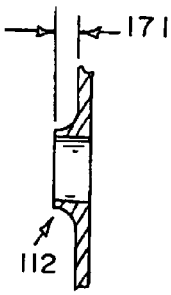
FIG. 9 is a sectional view of one of the air-mixing plate apertures taken along line 9—9 of FIG. 8.

Illustratively, the diameters of the apertures of the upper section of array 92 are as follows: six domes 110—0.312 inch; dome apertures 111—0.124 inch; first set 112 of four protrusion apertures—0.344 inch; second set 113 of four protrusion apertures—0.161 inch; third set 114 of four protrusion apertures—0.312 inch; fourth set 115 of four protrusion apertures—0.312 inch; fifth set 116 of six protrusion apertures—0.188 inch; five apertures 117—0.188 inch; two apertures 118—0.312 inch; and two apertures 119—0.250 inch. The height 171 of protrusion aperture 112 is 0.120 inch (FIG. 9). The height 172 of dome 110 is 0.124 inch and dome 110 forms an angle 173 of 41°. The height 174 of protrusion aperture 115 is 0.120 inch.

A lower section of array 92 includes first, second, third, fourth, fifth, and sixth rows 120, 121, 122, 123, 124, and 125, respectively, of apertures, as illustrated, for example, in FIGS. 8 and 13. These apertures are arranged in columns including first, second, third, fourth, fifth, sixth, seventh, and eighth columns 126, 127, 128, 129, 130, 131, 132, and 133, respectively. With respect to each row, the apertures nearer side edges 181, 183 of each air-mixing plate 14, 16 are larger than the apertures nearer a mid-line 153 to facilitate air flow through each air-mixing plate 14, 16 because this air flow may be somewhat inhibited by side flanges 182, 184, 186. With respect to the columns, the apertures become smaller going down each column. This is exemplified by illustrative dimensions now provided.

Illustratively, the diameters of the apertures of first row 120 is as follows: first, second, seventh, and eighth columns 126, 127, 132, 133—0.144 inch; third, fourth, fifth, and sixth columns 128, 129, 130, 131—0.136 inch; and the other eight apertures—0.125 inch. The diameters of the apertures of second row 121 is as follows: first, second, seventh, and eighth columns 126, 127, 132, 133—0.140 inch; third, fourth, fifth, and sixth columns 128, 129, 130, 131—0.128 inch; and the other eight apertures—0.116 inch.

Illustratively, the diameters of the apertures of third row 122 is as follows: first, second, seventh, and eighth columns 126, 127, 132, 133—0.108 inch; third, fourth, fifth, and sixth columns 128, 129, 130, 131—0.101 inch; and the other eight apertures—0.098 inch. The diameters of the apertures of fourth row 123 is as follows: first, second, seventh, and eighth columns 126, 127, 132, 133—0.101 inch; third, fourth, fifth, and sixth columns 128, 129, 130, 131—0.096 inch; and the other eight apertures—0.094 inch.

Illustratively, the diameters of the apertures of fifth row 124 is as follows: first, second, seventh, and eighth columns 126, 127, 132, 133—0.096 inch; third, fourth, fifth, and sixth columns 128, 129, 130, 131—0.089 inch; and the other eight apertures—0.082 inch. The diameters of the apertures of sixth row 125 is as follows: first, second, seventh, and eighth columns 126, 127, 132, 133—0.082 inch; third, fourth, fifth, and sixth columns 128, 129, 130, 131—0.078 inch; and the other eight apertures—0.076 inch.

Base portion 74 is also formed to include a plurality of apertures aligned with the columns of array 92, as illustrated, for example, in FIGS. 8 and 13. Illustratively, eight apertures 169 are aligned with the first through the eighth columns and have a diameter of 0.070 inch. Eight apertures 170 are aligned with the other columns and have a diameter of 0.063 inch.

Referring to FIG. 5, the following illustrative dimensions are provided: distance 134 between air-deflector wing 24 and base portion 74—6.000 inches; distance 135 between apertures 136—1.500 inches; distance 137 between lower aperture 136 and base portion 74—0.500 inch; angle 138—22.50°; angle 139—45°; width 140 between top edge 28 and outer wing edge 34—2.000 inches; width 141 of outer flange 149—0.750 inch; distance 142 between aperture 150 and an edge 151—0.250 inch; thickness 143 of outer flange 149—0.036 inch; width 145 of base portion 74—1.125 inch; distance 146—0.750 inch; distance 147—0.250 inch; and distance 148—0.500 inch.

Referring to FIG. 7, fuel manifold 12 includes the following illustrative dimensions: distance 175—0.178 inch; distance 176—1.625 inches; and distance 177—1.875 inches.

Figure 14:
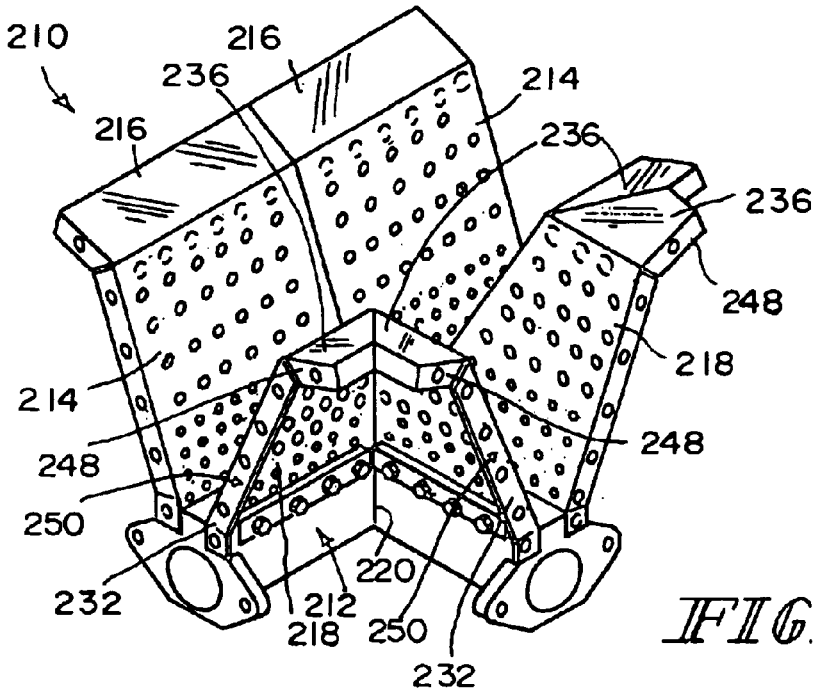
FIG. 14 is a perspective view of another burner including a T-shaped fuel manifold, a pair of straight air-mixing plates coupled to the manifold, and a pair of corner air-mixing plates coupled to the fuel manifold.
Figure 15:
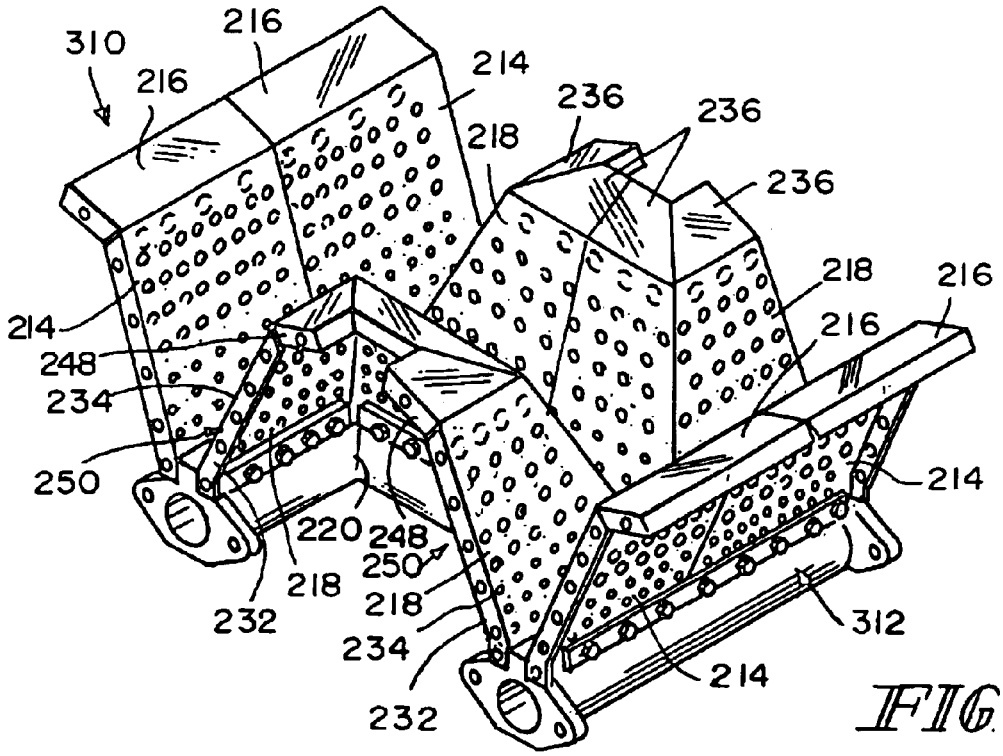
FIG. 15 is a perspective view of yet another burner including an H-shaped fuel manifold, straight air-mixing plates coupled to the fuel manifold, and corner air-mixing plates coupled to the fuel manifold.
Figure 16:
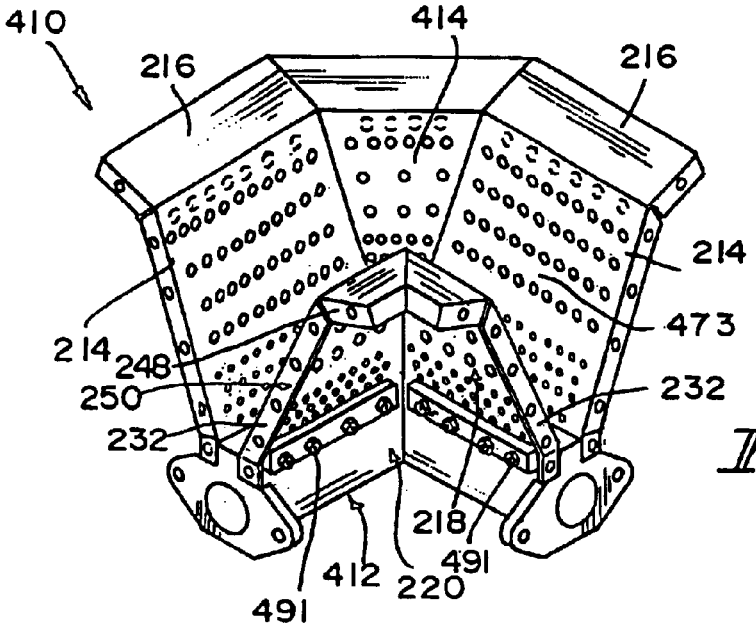
FIG. 16 is a perspective view of yet another burner including an elbow-shaped fuel manifold, straight air-mixing plates coupled to the fuel manifold, a corner air-mixing plate, and a wedge-shaped air-mixing plate.
Figure 17:
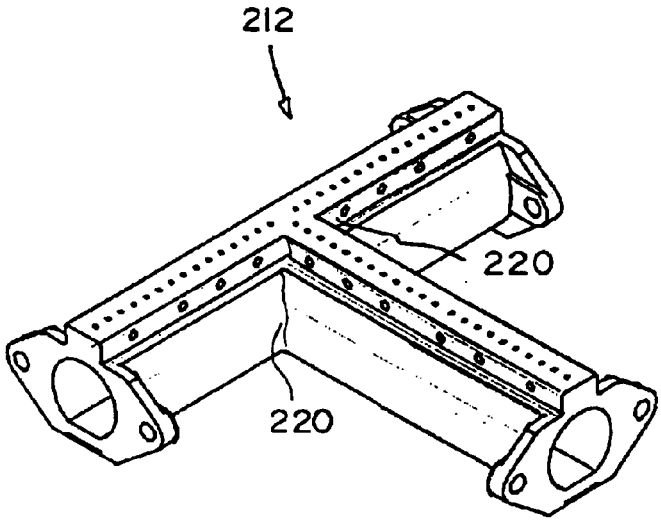
FIG. 17 is a perspective view of the T-shaped fuel manifold of the burner of FIG. 14.

Referring to FIG. 8, the following illustrative dimensions are provided:

distance 152 between aperture 119 and mid-line 153—2.75 inches; distance 154 between aperture 118 and mid-line 153—2.720 inches; distance 155 between protrusion aperture 114 and protrusion aperture 112—0.760 inch; distance 156 between adjacent protrusion apertures 112—0.75 inch; distance 157 between protrusion aperture 112 and mid-line—0.75 inch; distance 158 between dome 110 and aperture 119—0.313 inch; distance 159 between aperture 119 and aperture 114—1.125 inches; distance 160 between aperture 114 and aperture 117—0.938 inch; distance 161 between aperture 117 and first row 120—0.875 inch; distance 162 between first row 120 and second row 121—0.500 inch; distance 163 between second row 121 and third row 122—0.500 inch; distance 164 between third row 122 and fourth row 123—0.406 inch; distance 165 between fourth row 123 and fifth row 124—0.375 inch; distance 166 between fifth row 124 and sixth row 125—0.312 inch; distance 167 sixth row 125 and bottom portion 74—0.250 inch; and width 168—5.940 inches. Three more burners 210, 310, and 410 are illustrated in FIGS. 14, 15, and 16, respectively. Burner 210 includes a T-shaped fuel manifold 212 (see FIG. 17), burner 310 includes an H-shaped fuel manifold 312 (see FIG. 18), and burner 410 includes an elbow-shaped fuel manifold 412 (see FIG. 19).

Each burner 210, 310, and 410 includes "straight" perforated air-mixing plates 214 configured as described previously with respect to perforated air-mixing plates 14, 16. An air-deflector wing 216 configured as described previously with respect to air-deflector wings 24, 26 is coupled to each straight air-mixing plate 212.

Each burner 210, 310, and 410 includes one or more corner perforated air-mixing plates 218 as well. Each corner air-mixing plate 218 is described in more detail below. Each burner 210, 310, and 410 includes at least one corner 220 to which one corner air-mixing plate 218 is coupled. T-shaped burner 210 includes a pair of corners 220 and a corner air-mixing plate 218 is coupled to each corner 220 (see FIG. 14). H-shaped burner 310 includes four corner 220 and a corner air-mixing plate 218 is coupled to each one of those corners 220 (see FIG. 15). Elbow-shaped burner 410 includes a single corner 220 and a corner air-mixing plate 218 is coupled to that corner 220 (FIG. 16).

Figure 19:
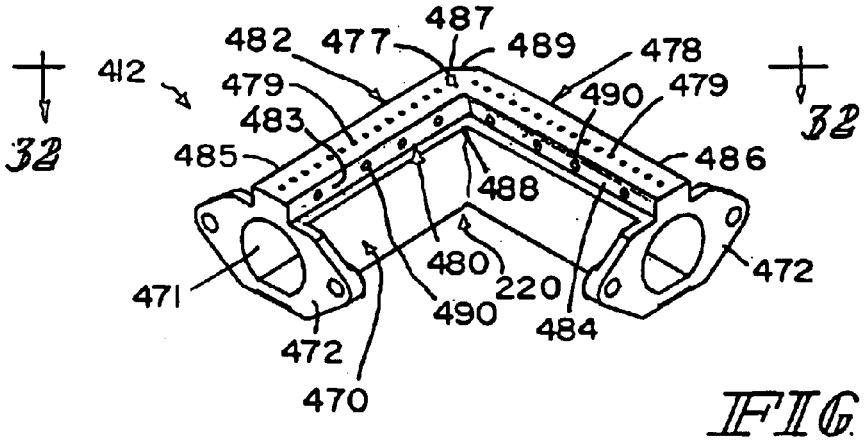
FIG. 19 is a perspective view of the elbow-shaped fuel manifold of the burner of FIG. 16.
Figure 18:
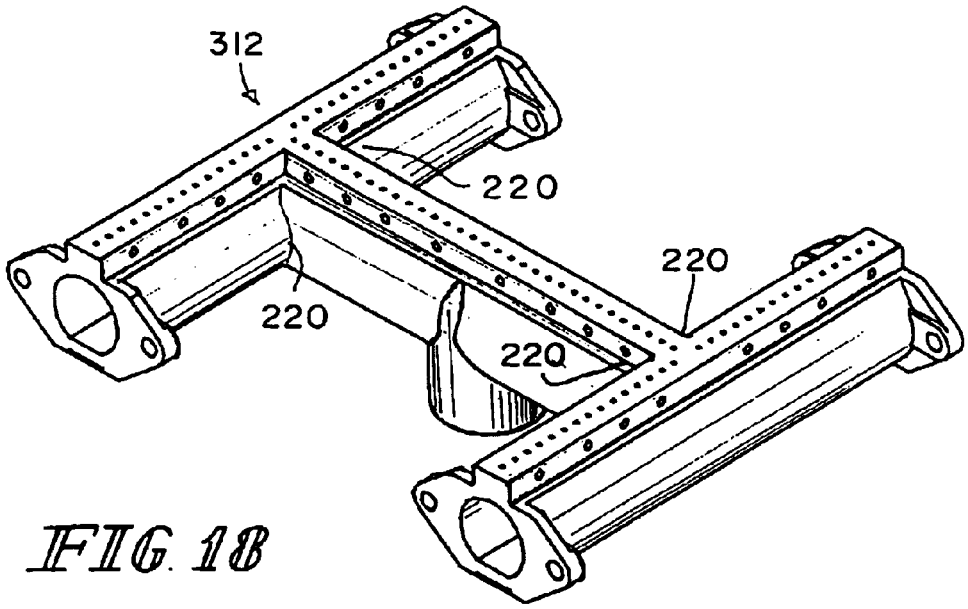
FIG. 18 is a perspective view of the H-shaped fuel manifold of the burner of FIG. 15.

Elbow-shaped burner 410 further includes a wedge-shaped air-mixing plate 414, as illustrated, for example, in FIGS. 18, 19, and 28. Wedge air-mixing plate 414 is supported by fuel manifold 412. Wedge air-mixing plate 414 is described in further detail below.

Fuel manifold 412 can be L-shaped, as illustrated, for example, in FIG. 19, or can be configured to define an acute angle or an obtuse angle. Fuel manifold 412 includes a base 470 formed to include a curved fuel transfer passageway 471, mounting flanges 472 at opposite ends of base 472, and a plate spacer 478 coupled to a top portion of base 470, as illustrated, for example, in FIG. 19. Base 470 and plate spacer 478 cooperate to define a turn 477 of fuel manifold 412.

Plate spacer 478 is formed to include a plurality of fuel-flow apertures 479 in communication with fuel transfer passageway 471 to dispense fuel into a fuel-air mixing region 473 defined between air-mixing plates 214, 218, 414, as illustrated, for example, in FIGS. 16 and 27.

Figure 32:
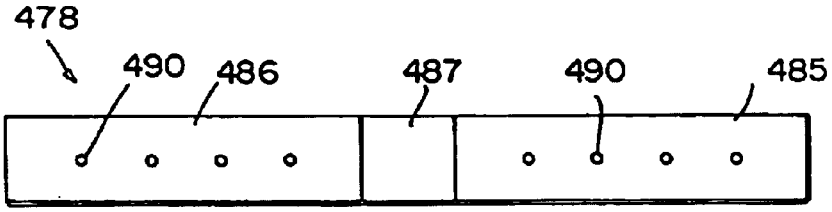
FIG. 32 is an elevation view as viewed in a direction suggested by line 32—32 of FIG. 19 showing a plate spacer of the fuel manifold of FIG. 19.

Plate spacer 478 includes an inner portion 480 and an outer portion 482, as illustrated, for example, in FIGS. 19 and 32. Inner portion 480 includes a first plate-engaging face 483 extending in a first direction and a second plate-engaging face 484 extending in a second direction. Corner air-mixing plate 218 is coupled to faces 483, 484. Outer portion 482 includes a first plate-engaging face 485 extending in the first direction, a second plate-engaging face 486 extending in the second direction, and a third plate-engaging face 487 coupled to the first and second plate-engaging faces 485, 486, as illustrated, for example, in FIG. 32.

Straight air-mixing plates are coupled to the first and second plate-engaging faces 485, 486 via fasteners 491 received within apertures 490, as illustrated, for example, in FIGS. 16, 19, 27, and 32. Wedge air-mixing plate 414 engages the third plate-engaging face 487.

First and second plate-engaging faces 483, 484 cooperate to define part of inner portion 488 of turn 477. Inner portion 488 also defines part of corner 220 of fuel manifold 412. Third plate-engaging face 487 defines part of a turn outer portion 489 of turn 477. Corresponding portions of base 470 of fuel manifold 412 define the remainder of turn inner portion 488 and turn outer portion 489.

Figure 20:
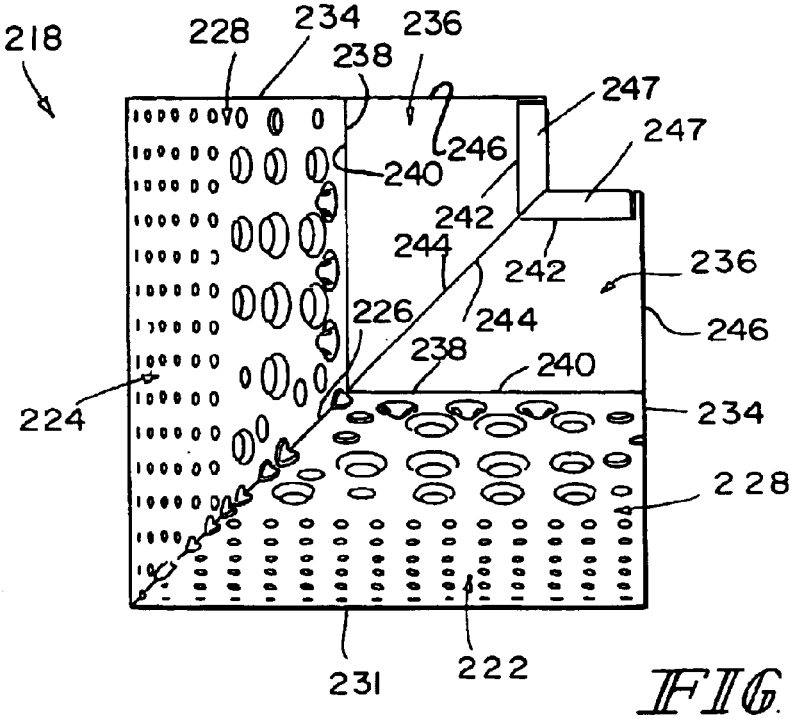
FIG. 20 is a top plan view of a corner air-mixing plate.

Corner air-mixing plate 218 includes a first section 222 and a second section 224 coupled to first section 222 along an intermediate edge 226, as illustrated, for example, in FIG. 20. The structure of first and second sections 222, 224 are similar to one another so that the description of first section 222 applies also to second section 224, except as otherwise noted.

Figure 21:
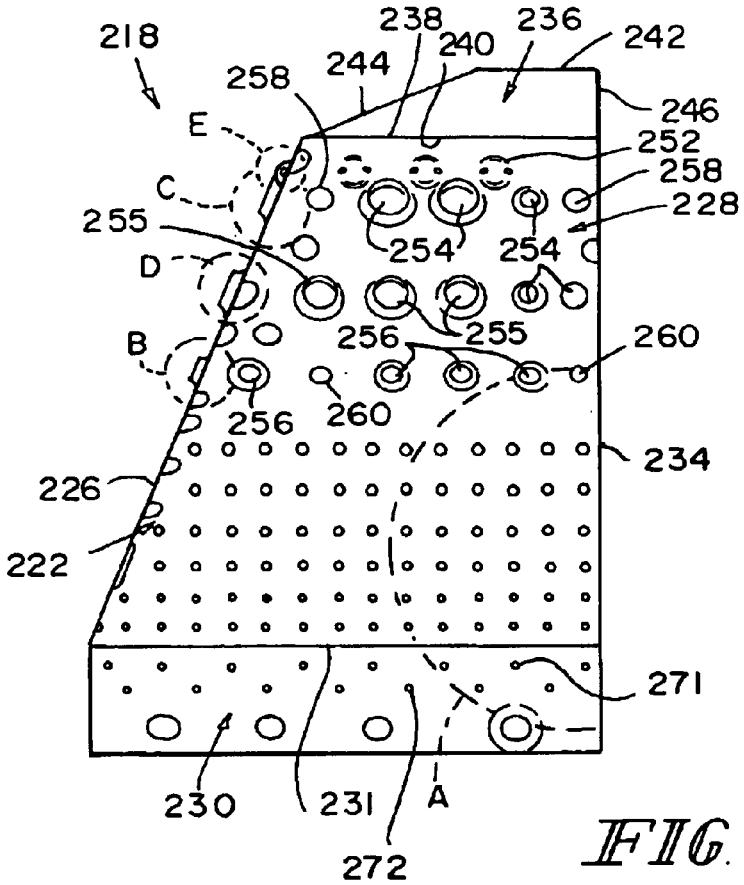
FIG. 21 is a side elevation view of the corner air-mixing plate of FIG. 18.

First section 222 includes a trapezoid-shaped panel 228 and a base portion 230 coupled to a bottom edge 231 of panel 228, as illustrated, for example, in FIG. 21. Base portion 230 is coupled to the plate spacer of respective fuel manifold 212, 312, 412 to mount corner air-mixing plate 218 thereto. A side flange 232 is coupled to a side edge 234 of panel 228.

An air-deflector wing 236 is coupled to a top edge 238 of panel 228, as illustrated, for example, in FIGS. 20 and 21. Air-deflector wing 236 is trapezoid-shaped so that it includes an inner edge 240 coupled to top edge 238, an outer edge 242 parallel to and shorter than inner edge 240, and non-parallel side edges 244, 246. Side edge 244 of first section 222 and side edge 244 of second section 224 are parallel to one another. An outer flange 247 is coupled to and extends downwardly from outer edge 242.

A side flange 248 is coupled to side edge 246. Side flanges 232, 248 cooperate to define a connector 250, as illustrated, for example, in FIGS. 14–16. Connector 250 is configured to be coupled to an adjacent air-mixing plate.

Figure 23:
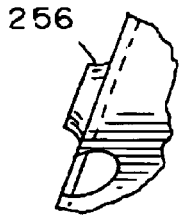
FIG. 23 is an enlarged view of a region B of the corner air-mixing plate shown in FIG. 21.
Figure 24:
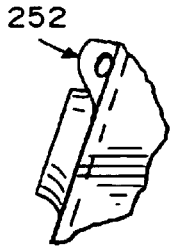
FIG. 24 is an enlarged view of a region C of the corner air-mixing plate shown in FIG. 21.
Figure 25:
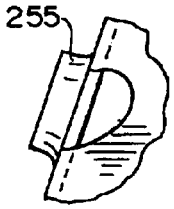
FIG. 25 is an enlarged view of a region D of the corner air-mixing plate shown in FIG. 21.
Figure 26:
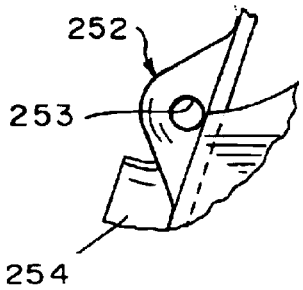
FIG. 26 is an enlarged view of a region E of the corner air-mixing plate shown in FIG. 21.

Panel 228 is formed to include a plurality of apertures through which air can flow, as illustrated, for example, in FIGS. 20 and 21. An upper section of panel 228 is formed to include three circular domes 252 (FIG. 26) each being formed to include a pair of dome apertures 253, a first set 254 of protrusion apertures (FIG. 24), a second set 255 of protrusion apertures (FIG. 25), a third set 256 of protrusion apertures (FIG. 23), a fourth set 257 of protrusion apertures (FIG. 21), and other apertures including a pair of upper apertures 258 (FIG. 21), an intermediate aperture 259 (FIG. 21), and a pair of smaller apertures 260 (FIG. 21), as illustrated, for example, in FIGS. 20 and 21.

Illustratively, the diameters of the apertures of the upper section of panel 228 are as follows: dome apertures—0.070 inch; first set 254 of protrusion apertures—0.344 inch; a second set 255 of protrusion apertures—0.312 inch; a third set 256 of protrusion apertures—0.188 inch; a fourth set 257 of protrusion apertures—0.161 inch; pair of upper apertures 258—0.250 inch; an intermediate aperture 259—0.312 inch; and a pair of smaller apertures 260—0.188 inch.

Figure 22:
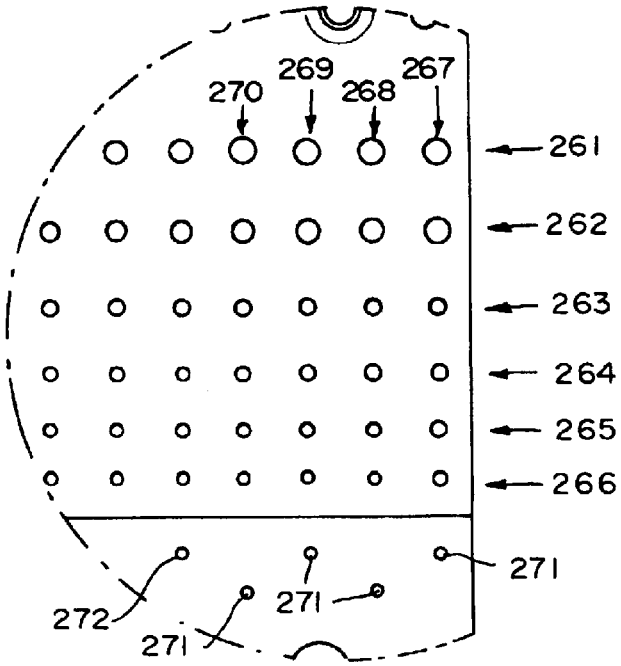
FIG. 22 is an enlarged view of a region A of the corner air-mixing plate shown in FIG. 21.

A lower section of panel 228 is formed to include a plurality of apertures including first, second, third, fourth, fifth, and sixth rows 261, 262, 263, 264, 265, and 266, respectively, as illustrated, for example, in FIGS. 21 and 22. The apertures of these rows are arranged in a plurality of columns including first, second, third, and fourth columns 267, 268, 269, and 270, respectively, which are nearest side edge 234. With respect to each row, the apertures nearer side edge 234 are larger than the apertures nearer intermediate edge 226 to facilitate air flow through corner air-mixing plate 218 because this air flow may be somewhat inhibited by side flanges 232, 248. With respect to the columns, the apertures become smaller going down each column. This is exemplified by illustrative dimensions now provided.

Illustratively, the diameters of the apertures of first row 261 are as follows: apertures of first and second columns 267, 268—0.144 inch; apertures of third and fourth columns 269, 270—0.136 inch; the other 8 apertures—0.125 inch. The diameters of the apertures of second row 262 are as follows: apertures of first and second columns 267, 268—0.140 inch; apertures of third and fourth columns 269, 270—0.128 inch; the other 8 apertures—0.116 inch.

Illustratively, the diameters of the apertures of third row 263 are as follows: apertures of first and second columns 267, 268—0.106 inch; apertures of third and fourth columns 269, 270—0.101 inch; the other 9 apertures—0.098 inch. The diameters of the apertures of fourth row 264 are as follows: apertures of first and second columns 267, 268—0.101 inch; apertures of third and fourth columns 269, 270—0.098 inch; the other 9 apertures—0.093 inch.

Illustratively, the diameters of the apertures of fifth row 265 are as follows: apertures of first and second columns 267, 268—0.098 inch; apertures of third and fourth columns 269, 270—0.089 inch; the other 10 apertures—0.082 inch. The diameters of the apertures of sixth row 266 are as follows: apertures of first and second columns 267, 268—0.082 inch; apertures of third and fourth columns 269, 270—0.078 inch; the other 10 apertures—0.076 inch.

Base portion 230 is also formed to include a plurality of apertures aligned with the columns of panel 228, as illustrated, for example, in FIGS. 21 and 22. Illustratively, the four apertures 271 aligned with the first four columns 267, 268, 269, 270 have a diameter of 0.070 inch and the other 11 apertures 272 have a diameter of 0.064 inch.

A burner member 413 includes wedge air-mixing plate 414. Wedge air-mixing plate 414 includes a trapezoid-shaped panel 417, a left side flange 421 coupled to panel 417 along a left side edge 419, a right side flange 420 coupled to panel 417 along a right side edge 422, and a base portion 424 coupled to panel 417 along a bottom edge 426, as illustrated, for example, in FIGS. 27–29. Base portion 424 includes a left side flange 425, a right side flange 429, and an intermediate portion 427 that is coupled to bottom edge 426 and abuts third plate-engaging face 487 of outer portion 482 of plate spacer 478.

Burner member 413 further includes an air-deflector wing 428 which is coupled to a top edge 430, as illustrated, for example, in FIGS. 27–29. Air-deflector wing 428 is trapezoid-shaped so that it includes an inner edge 432 coupled to top edge 430, an outer edge 434 parallel to and longer than inner edge 432, and non-parallel left and right side edges 435, 436.

A left side flange 438 of burner member 413 is coupled to left side edge 435 and a right side flange 440 of burner member 413 is coupled to a right side edge 436, as illustrated, for example, in FIG. 29. An outer flange 459 of burner member 413 is coupled to and extends downwardly from outer edge 434.

Left side flanges 421, 425, 438 cooperate to define a left connector 442 that is coupled to one of straight air-mixing plates 214 and one of air-deflector wings 216. Right side flanges 420, 429, 440 cooperate to define a right connector 444 that is coupled to the other of straight air-mixing plates 214 and the other of air-deflector wings 216. Base portions 274 of straight air-mixing plates 214 are coupled to plate spacer 478 of fuel manifold 412. Wedge air-mixing plate 414 is thus coupled to fuel manifold 412 via the straight air-mixing plates 214.

Panel 417 is formed to include a plurality of apertures through which air can flow, as illustrated, for example, in FIG. 28. An upper section of panel 417 includes four circular domes 448 (see also FIG. 30) each being formed to include a pair of apertures 449, five protrusion apertures 450 (see also FIG. 31), and six side apertures 452. A lower section of panel 417 includes six rows 453, 454, 455, 456, 457, and 458.

Illustratively, the diameters of the panel apertures are as follows: dome apertures 449—0.070 inch; protrusion apertures 450—0.161 inch; side apertures 452—0.250 inch; first row 453—0.125 inch; second row 454—0.116 inch; third row 455—0.098 inch; fourth row 456—0.094 inch; fifth row 457—0.082 inch; sixth row 458—0.076 inch.

An illustrative tolerance for the dimensions detailed herein is +/−0.005 inch, unless noted otherwise. For the diameters of the various apertures detailed herein, an illustrative tolerance is 0.010 inch. For angles, an illustrative tolerance is +/−1°.

Although the invention has been disclosed in detail with reference to certain illustrative embodiments, variations and modifications exist within the scope and spirit of the invention as described and defined in the following claims.

What is claimed is:

1. A burner comprising a fuel manifold and air-mixing plates coupled to the fuel manifold to define a fuel-air mixing region therebetween above the fuel manifold, a first of the air-mixing plates including a first side edge extending upwardly relative to the fuel manifold, the first of the air-mixing plates being formed to include a first row of apertures, the first row of apertures including a first aperture, a second aperture, and a third aperture, the first aperture being larger than and closer to the first side edge than the second aperture and the third aperture, the second aperture being larger than and closer to the first side edge than the third aperture.

2. The burner of claim 1, wherein the first row of apertures includes a fourth aperture and the fourth aperture is the same size as the first aperture and is positioned between the first aperture and the second aperture.

3. The burner of claim 2, wherein the first row of apertures includes a fifth aperture and the fifth aperture is the same size as the second aperture and is positioned between the second aperture and the third aperture.

4. The burner of claim 1, wherein the first of the air-mixing plates is formed to include a second row of apertures including a fourth aperture, a fifth aperture, and a sixth aperture, the fourth aperture is larger than and closer to the first side edge than the fifth aperture and the sixth aperture, and the fifth aperture is larger than and closer to the first side edge than the sixth aperture.

5. The burner of claim 4, wherein the first aperture and the fourth aperture are arranged in a first column, the second aperture and the fifth aperture are arranged in a second column, and the third aperture and the sixth aperture are arranged in a third column.

6. The burner of claim 5, wherein the first aperture is larger than the fourth aperture, the second aperture is larger than the fifth aperture, and the third aperture is larger than the sixth aperture.

7. The burner of claim 6, wherein the first row of apertures further includes a seventh aperture and an eighth aperture, the seventh aperture is the same size as the first aperture and is positioned between the first aperture and the second aperture, the eighth aperture is the same size as the second aperture and is positioned between the second aperture and the third aperture, the second row of apertures includes a ninth aperture and a tenth aperture, the ninth aperture is the same size as the fourth aperture and is positioned between the fourth aperture and the fifth aperture, the tenth aperture is the same size as the fifth aperture and is positioned between the fifth aperture and the sixth aperture, the seventh aperture and the ninth aperture cooperate to define a fourth column, and the eighth aperture and the tenth aperture cooperate to define a fifth column.

8. The burner of claim 1, wherein the first of the air-mixing plates includes a second side edge extending upwardly relative to the fuel manifold and the first row of apertures includes a fourth aperture, a fifth aperture, and a sixth aperture, the fourth aperture is larger than and closer to the second side edge than the fifth aperture and the sixth aperture, and the fifth aperture is larger than and closer to the second side edge than the sixth aperture.

9. The burner of claim 8, wherein the first aperture and the fourth aperture are the same size, the second aperture and the fifth aperture are the same size, and the third aperture and the sixth aperture are the same size.

10. The burner of claim 1, wherein the first of the air-mixing plates is coupled to a corner of the fuel manifold and includes a first panel and a second panel angled relative to the first panel, the first panel is provided with the first side edge and the first row of apertures, the second panel includes a second side edge extending upwardly relative to the fuel manifold and is formed to include a second row of apertures positioned on a horizontal plane along with the first row of apertures, the second row of apertures includes a fourth aperture, a fifth aperture, and a sixth aperture, the fourth aperture is larger than and closer to the second side edge than the fifth aperture and the sixth aperture, and the fifth aperture is larger than and closer to the second side edge than the sixth aperture.

11. The burner of claim 10, wherein the first aperture and the fourth aperture are the same size, the second aperture and the fifth aperture are the same size, and the third aperture and the sixth aperture are the same size.

12. A burner comprising a fuel manifold, substantially flat perforated air-mixing plates coupled to the fuel manifold to define a fuel-air mixing region therebetween above the fuel manifold, a first of the perforated air-mixing plates including a top edge, a first side edge, and a second side edge, the first side edge and the second side edge diverging away from one another as the first side edge and the second side edge extend away from the fuel manifold to the top edge.

13. The burner of claim 12, wherein the first of the perforated air- mixing plates includes a first side flange coupled to the first side edge and a second side flange coupled to the second side edge and the first side flange and the second side flange diverge away from one another as the first side flange extends away from the first side edge and the second side flange extends away from the second side edge.

14. The burner of claim 12, wherein the fuel manifold length is elbow-shaped so that fuel manifold includes a turn including an inner portion and an outer portion and the first of the perforated air-mixing plates is coupled to the outer portion.

15. The burner of claim 12, further comprising an unperforated air-deflector wing extending upwardly from the top edge.

16. The burner of claim 15, wherein the unperforated air-deflector wing is trapezoid-shaped.

17. The burner of claim 15, wherein the air-deflector wing includes an inner edge coupled to the top edge and an outer edge parallel to and longer than the inner edge.

18. The burner of claim 17, further comprising an outer flange coupled to and extending downwardly from the outer edge.

19. A burner comprising a fuel manifold, perforated air-mixing plates coupled to the fuel manifold to define a fuel-air mixing region therebetween above the fuel manifold, a first of the perforated air-mixing plates including a top edge, a first side edge, and a second side edge, the first side edge and the second side edge diverging away from one another as the first side edge and the second side edge extend away from the fuel manifold to the top edge wherein the first of the perforated air-mixing plates includes a perforated panel including a bottom edge adjacent to the fuel manifold and the top edge, the bottom edge, the first side edge, and the second side edge cooperate to define a trapezoid-shaped periphery of the perforated panel.

20. The burner of claim 19, wherein the top edge is longer than and parallel to the bottom edge.

21. A burner member for a burner including a fuel manifold and at least one substantially flat perforated air-mixing plate coupled to the fuel manifold, the burner member comprising a base portion adapted to be supported by the fuel manifold and a perforated panel adapted to cooperate with the at least one substantially flat perforated air-mixing plate to define a fuel-air mixing region therebetween, the perforated panel being coupled to the base portion and including a top edge, a first side edge, and a second side edge, the first side edge and the second side edge diverging away from one another as the first side edge and the second side edge extend away from the base portion to the top edge.

22. The burner member of claim 21, further comprising a first side flange coupled to the first side edge and a second side flange coupled to the second side edge and the first side flange and the second side flange diverge away from one another as the first side flange extends away from the first side edge and the second side flange extends away from the second side edge.

23. The burner of claim 21, further comprising an unperforated air-deflector wing coupled to and extending upwardly from the top edge.

24. The burner of claim 23, wherein the unperforated air-deflector includes an inner edge coupled to the top edge and an outer edge parallel to the inner edge.

25. The burner member of claim 24, further comprising an outer flange coupled to and extending downwardly from the outer edge.

26. A burner member for a burner including a fuel manifold and at least one perforated air-mixing plate coupled to the fuel manifold, the burner member comprising a base portion adapted to be supported by the fuel manifold and a perforated panel adapted to cooperate with the at least one perforated air-mixing plate to define a fuel-air mixing region therebetween, the perforated panel being coupled to the base portion and including a top edge, a first side edge, and a second side edge, the first side edge and the second side edge diverging away from one another as the first side edge and the second side edge extend away from the base portion to the top edge wherein the perforated panel is coupled to the base portion along a bottom edge of the perforated panel and the top edge, the bottom edge, the first side edge, and the second side edge cooperate to define a trapezoid-shaped periphery of the perforated panel.

27. The burner member of claim 26, wherein the top edge is longer than and parallel to the bottom edge.

* * * * *